US010157569B2

(12) United States Patent
Kim et al.

(10) Patent No.: US 10,157,569 B2
(45) Date of Patent: Dec. 18, 2018

(54) ORGANIC LIGHT-EMITTING DISPLAY APPARATUS AND METHOD OF DRIVING THE SAME

(71) Applicant: SAMSUNG DISPLAY CO., LTD., Yongin, Gyeonggi-Do (KR)

(72) Inventors: Cheolmin Kim, Yongin (KR); Hyungryul Kang, Yongin (KR); Jungyu Lee, Yongin (KR); Sebyung Chae, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 430 days.

(21) Appl. No.: 14/675,228

(22) Filed: Mar. 31, 2015

(65) Prior Publication Data

US 2016/0148564 A1 May 26, 2016

(30) Foreign Application Priority Data

Nov. 21, 2014 (KR) ..... 10-2014-0163819

(51) Int. Cl.
*G09G 3/3233* (2016.01)

(52) U.S. Cl.
CPC ... *G09G 3/3233* (2013.01); *G09G 2300/0861* (2013.01); *G09G 2320/0295* (2013.01); *G09G 2320/043* (2013.01)

(58) Field of Classification Search
None
See application file for complete search history.

(56) References Cited

U.S. PATENT DOCUMENTS

2005/0122300 A1* 6/2005 Makuuchi ..... G09G 3/006 345/95
2007/0024540 A1* 2/2007 Ryu ..... G09G 3/3233 345/76
2010/0214273 A1* 8/2010 Shirouzu ..... G09G 3/3233 345/205

(Continued)

FOREIGN PATENT DOCUMENTS

JP 2010-281874 A 12/2010
KR 10-2012-0073825 A 7/2012

(Continued)

*Primary Examiner* — Matthew Yeung
(74) *Attorney, Agent, or Firm* — Lewis Roca Rothgerber Christie LLP

(57) ABSTRACT

An organic light-emitting display apparatus includes a plurality of pixels, each including: an organic light emitting diode (OLED); a driving transistor; and a first node therebetween; a sensor for sensing a first current from the driving transistor when a first reference voltage is applied to the first node and sensing a second current from the driving transistor when a second reference voltage is applied to the first node, when a first source data signal, corresponding to a first gray level, is transferred to a corresponding one of the pixels; a driving current determiner for generating characteristic information of the driving transistor based on the first and the second currents and determining a driving current of the driving transistor, corresponding to the first gray level, based on the characteristic information of the driving transistor and current-voltage information of the OLED, which is stored in the memory.

20 Claims, 8 Drawing Sheets

(56) References Cited

U.S. PATENT DOCUMENTS

| | | | | |
|---|---|---|---|---|
| 2011/0109660 | A1* | 5/2011 | Kim | G09G 3/3233 345/690 |
| 2011/0254871 | A1* | 10/2011 | Yoo | G09G 3/3233 345/690 |
| 2012/0169704 | A1* | 7/2012 | Chung | G09G 3/3233 345/212 |
| 2013/0050292 | A1 | 2/2013 | Mizukoshi | |
| 2013/0162617 | A1* | 6/2013 | Yoon | G09G 3/3291 345/211 |
| 2014/0176625 | A1 | 6/2014 | Yoon et al. | |

FOREIGN PATENT DOCUMENTS

| | | | |
|---|---|---|---|
| KR | 10-2012-0079364 | A | 7/2012 |
| KR | 10-2013-0024744 | A | 3/2013 |

* cited by examiner

ORGANIC LIGHT-EMITTING DISPLAY APPARATUS AND METHOD OF DRIVING THE SAME

CROSS-REFERENCE TO RELATED APPLICATION

This application claims priority to and the benefit of Korean Patent Application No. 10-2014-0163819, filed on Nov. 21, 2014, in the Korean Intellectual Property Office, the disclosure of which is incorporated herein in its entirety by reference.

BACKGROUND

1. Field

One or more exemplary embodiments relate to an organic light-emitting display apparatus and a method of driving the same.

2. Description of the Related Art

Flat panel display apparatuses, such as liquid crystal displays and organic light-emitting displays, use thin film transistors (TFTs) to drive pixels. Although it is desirable for TFTs to have uniform characteristics, the TFTs may have different characteristics due to process variations. Also, although a TFT is controlled by a gate-source voltage in general, it may also be affected by variables other than the gate-source voltage, such as an aspect ratio due to process variations and a source-drain voltage. Alternatively, deterioration may also change the characteristics of a TFT. These aspects may make an intended operation, such as accurate color display, difficult to perform.

SUMMARY

One or more exemplary embodiments include an organic light-emitting display apparatus capable of accurately detecting an operation point of a driving transistor, and a method of driving the organic light-emitting display apparatus.

Additional aspects will be set forth in part in the description which follows and, in part, will be apparent from the description, or may be learned by practice of the presented embodiments.

According to one or more exemplary embodiments, an organic light-emitting display apparatus includes a plurality of pixels, a sensor, a memory, and a driving current determiner. Each of the plurality of pixels may include an organic light-emitting diode (OLED) and a driving transistor for supplying a driving current to the OLED via a first node. The sensor may be configured to sense a first current flowing from the driving transistor in a state in which a first reference voltage is applied to the first node and to sense a second current flowing from the driving transistor in a state in which a second reference voltage is applied to the first node, when a first source data signal, corresponding to a first gray level, is transferred to a corresponding one of the pixels. The memory may be configured to store current-voltage information of the OLED. The driving current determiner may be configured to generate characteristic information of the driving transistor based on the first current when the first reference voltage is applied and the second current when the second reference voltage is applied, and to determine a driving current of the driving transistor, corresponding to the first gray level, based on the characteristic information of the driving transistor and the current-voltage information of the OLED.

The sensor may be configured to sense a third current flowing from the driving transistor in a state in which a third reference voltage is applied to the first node, when a second source data signal, corresponding to a second gray level that is different from the first gray level, is transferred to the corresponding one of the pixels. The driving current determiner may be configured to determine a driving current of the driving transistor, corresponding to the second gray level, based on the third current when the third reference voltage is applied, the characteristic information of the driving transistor, and the current-voltage information of the OLED.

The characteristic information of the driving transistor may include a channel-length modulation parameter when the driving transistor operates in a saturated region.

The sensor may include a reference voltage generator and a current sensor. The reference voltage generator may be configured to generate the first reference voltage and the second reference voltage which are to be applied to the first node, and the current sensor may be configured to sense the first current and the second current.

The driving current determiner may be configured to determine a voltage of the first node when the first source data signal is transferred to the corresponding one of the pixels and determine the driving current when the first source data signal is transferred to the corresponding one of the pixels, based on the characteristic information of the driving transistor and the current-voltage information of the OLED.

The organic light-emitting display apparatus may further include a power supply configured to supply a first power voltage (ELVDD) and a second power voltage (ELVSS) to the corresponding one of the pixels. A difference between the first power voltage and a voltage of the first node may determine a source-drain voltage of the driving transistor, and wherein a difference between the voltage of the first node and the second power voltage may determine a voltage across the OLED.

The organic light-emitting display apparatus may further include a sensing driver configured to generate and output a first sensing signal and a second sensing signal to a sensing line connected to the corresponding one of the pixels. The sensor may apply the first reference voltage to the first node and sense the first current in response to the first sensing signal, and may apply the second reference voltage to the first node and sense the second current in response to the second sensing signal.

The sensor may sense an emission current flowing through the OLED in the state in which a reference voltage is applied to the first node. The organic light-emitting display apparatus may further include a characteristic information generator configured to generate the current-voltage information of the OLED based on the emission current in the state in which the reference voltage is applied and to store the generated current-voltage information in the memory.

The corresponding one of the pixels may be connected to a scan line transferring a scan signal, a gate line transferring a gate signal, a data line transferring an image data signal and the first source data signal, and a sensing line transferring a sensing signal.

The sensor may receive the first current and the second current via the data line.

The organic light-emitting display apparatus may further include a data driver and a switching unit. The data driver may be configured to supply the image data signal and the first source data signal to the corresponding one of the pixels, and a switching unit may be configured to selectively connect the data line to any one of the data driver and the sensor.

The switching unit may include a first selection switch which is connected between the data driver and the data line, the first selection switch may transfer the image data signal and the first source data signal from the data driver to the corresponding one of the pixels in a turned-on state, and a second selection switch which is connected between the sensor and the data line, the second selection switch may transfer the first current and the second current output from the driving transistor to the sensor in a turned-on state.

Each of the pixels may include a switching transistor for transferring the image data signal in response to the scan signal, the driving transistor for outputting the driving current according to the image data signal via the first node, a connection transistor for connecting the driving transistor and the OLED in response to the gate signal, and a sensing transistor for transferring the first current and the second current output from the driving transistor to the sensor in response to the sensing signal.

The scan signal may have a gate-on voltage level of the switching transistor when the first source data signal and the image data signal are transferred to the corresponding one of the pixels.

The gate signal may have a gate-off voltage level of the connection transistor when the first current and the second current are sensed by the sensor.

The sensing signal may have a gate-on voltage level of the sensing transistor when the first current and the second current are sensed by the sensor.

The corresponding one of the pixels may be connected to a scan line for transferring a scan signal, a gate line for transferring a gate signal, a data line for transferring an image data signal and the first source data signal, a sensing line for transferring a sensing signal, and a connection line for transferring the first current and the second current to the sensor.

According to one or more exemplary embodiments, there is provided a method of driving an organic light-emitting display apparatus. According to the method, a first source data signal, corresponding to a first gray level, may be transferred to a pixel including an organic light-emitting diode (OLED) and a driving transistor which are connected to each other via a first node. A first current flowing from the driving transistor in a state in which a first reference voltage is applied to the first node may be sensed. A second current flowing from the driving transistor in a state in which a second reference voltage is applied to the first node may be sensed. Characteristic information of the driving transistor may be generated, based on the first current when the first reference voltage is applied and on the second current when the second reference voltage is applied. A driving current of the driving transistor, corresponding to the first gray level, may be determined based on the characteristic information of the driving transistor and current-voltage information of the OLED.

According to the method, a second source data signal, corresponding to a second gray level that is different from a first target brightness, may be transferred to the pixel. A third current flowing from the driving transistor in a state in which a third reference voltage is applied to the first node may be sensed. A driving current of the driving transistor, corresponding to the second gray level, may be determined based on the third current when the third reference voltage is applied, on the characteristic information of the driving transistor, and on the current-voltage information of the OLED.

The characteristic information of the driving transistor may include a channel-length modulation parameter when the driving transistor operates in a saturated region.

Embodiments of the present invention may provide an organic light-emitting display apparatus capable of accurately detecting an operation point of a driving transistor of the organic light-emitting display apparatus and a method of driving the organic light-emitting display apparatus

BRIEF DESCRIPTION OF THE DRAWINGS

These and/or other aspects will become apparent and more readily appreciated from the following description of the exemplary embodiments, taken in conjunction with the accompanying drawings in which.

DETAILED DESCRIPTION

Figure 1:
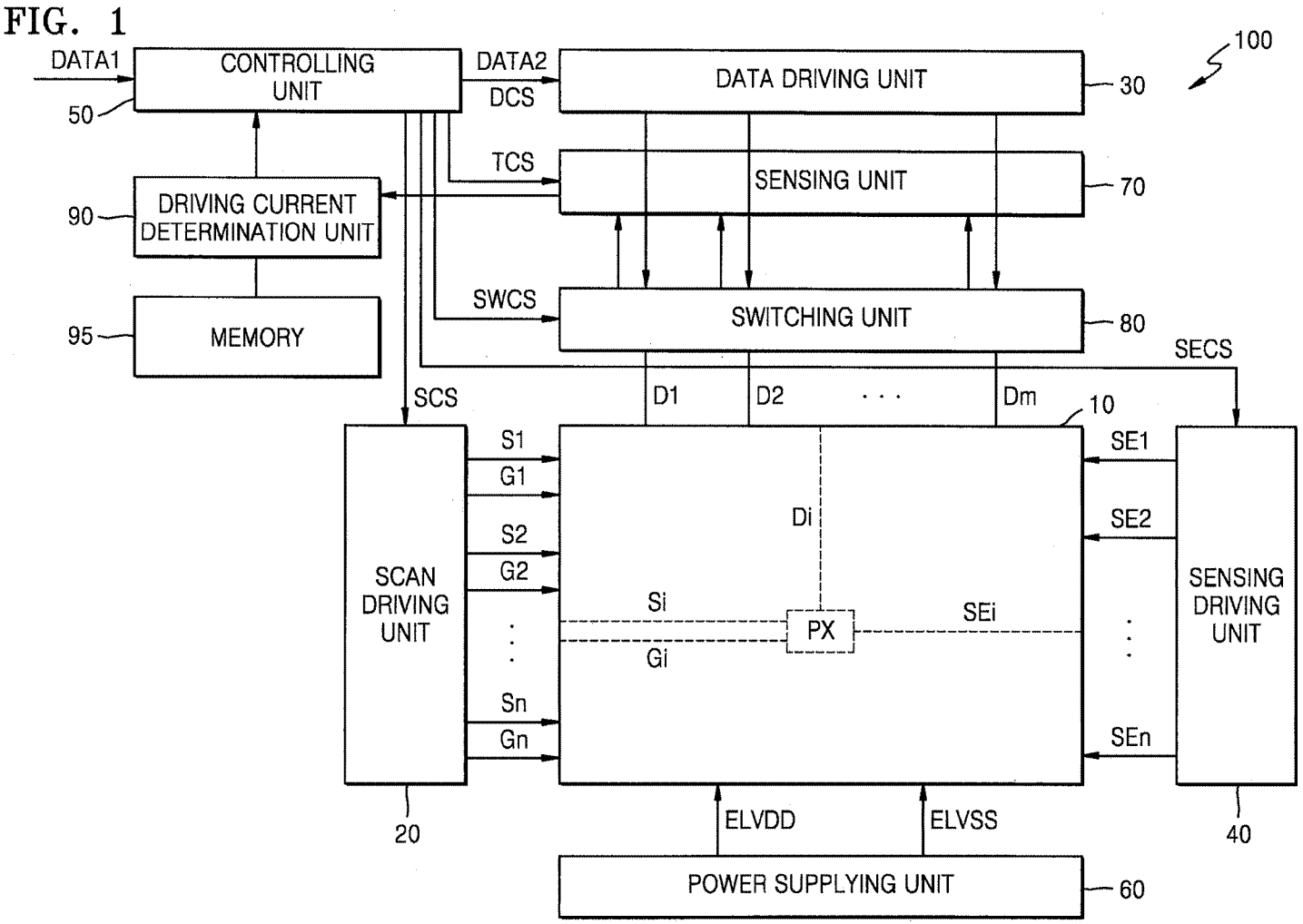
FIG. 1 is a block diagram of an organic light-emitting display apparatus according to an embodiment.

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description.

The terminology used herein is for the purpose of describing particular embodiments only and is not intended to be limiting of the present invention. As used herein, the term "and/or" includes any and all combinations of one or more of the associated listed It will be understood that, although the terms "first," "second," "third," etc. may be used herein to describe various elements, components, regions, layers and/or sections, these elements, components, regions, layers, and/or sections should not be limited by these terms. These terms are only used to distinguish one element, component, region, layer, and/or section from another element, component, region, layer, and/or section. Thus, a first element, component, region, layer, or section discussed below could be termed a second element, component, region, layer, or section, without departing from the spirit and scope of the present invention.

Further, it will also be understood that when one element, component, region, layer and/or section is referred to as being "between" two elements, components, regions, layers, and/or sections, it can be the only element, component, region, layer and/or section between the two elements, components, regions, layers, and/or sections, or one or more intervening elements, components, regions, layers, and/or sections may also be present.

As used herein, the singular forms "a" and "an" are intended to include the plural forms as well, unless the context clearly indicates otherwise. Throughout the specification, it will be understood that when an element is referred to as being "connected to," "on," "coupled to," "connected with," "coupled with," or "adjacent to" another element, it may be "directly connected to," "directly on," "directly coupled to," "directly connected with," "directly coupled with," or "directly adjacent to" the other element or one or more intervening elements may be present. It will be further understood that the terms "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

The organic light-emitting display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the organic light-emitting display apparatus may be formed on one integrated circuit (IC) chip or on separate IC chips. Further, the various components of the organic light-emitting display apparatus may be implemented on a flexible printed circuit film, a tape carrier package (TCP), a printed circuit board (PCB), or formed on a same substrate as the organic light-emitting display apparatus. Further, the various components of the organic light-emitting display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

Also, any numerical range recited herein is intended to include all subranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include ail higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112, first paragraph, and 35 U.S.C. § 132(a).

FIG. 1 is a block diagram of an organic light-emitting display apparatus 100 according to an embodiment.

Referring to FIG. 1, the organic light-emitting display apparatus 100 includes a display unit 10, a sensing unit (or a sensor) 70, a driving current determination unit (or a driving current determiner) 90, and a memory 95. The organic light-emitting display apparatus 100 may further include a scan driving unit (or a scan driver) 20, a data driving unit (or a data driver) 30, a sensing driving unit (or a sensing driver) 40, a controlling unit (or a controller) 50, a power supplying unit (or a power supply) 60, and/or a switching unit 80.

The display unit 10 includes at least one pixel PX. The pixel PX includes an organic light-emitting diode (OLED), and a driving transistor for supplying a driving current according to an image data signal to the OLED. The OLED and the driving transistor are connected to each other via a first node (N1 of FIG. 3). The pixel PX illustrated in FIG. 1 is connected to a corresponding scan line Si among scan lines S1 through Sn, a corresponding gate line Gi among gate lines G1 through Gn, a corresponding sensing line SEi among sensing lines SE1 through SEn, and a corresponding data line D1 among data lines D1 through Dm.

Although FIG. 1 illustrates one pixel PX, the display unit 10 may include a plurality of pixels PX. The plurality of pixels PX may be connected to the scan lines S1 through Sn and the gate lines G1 through Gn which are connected to the scan driving unit 20, the sensing lines SE1 through Sen which are connected to the sensing driving unit 40, and the data lines D1 through Dm which are selectively connected to the data driving unit 30 and the sensing unit 70. In other embodiments, the pixels PX may be connected to connection lines (B1 through Bm of FIG. 4) connected to the sensing unit 70. In this case, the data lines D1 through Dm may be connected to the data driving unit 30. An embodiment in which the connection lines B1 through Bm are connected to the sensing unit 70 will be described later with reference to FIG. 4.

The pixels PX of the display unit 10 receive a first power voltage ELVDD and a second power voltage ELVSS from the power supplying unit 60. The power supplying unit 60 supplies the first power voltage ELVDD and the second power voltage ELVSS which has a lower level than the first power voltage ELVDD to the display unit 10.

The pixel PX may control a current that is supplied from the first power voltage ELVDD to the second power voltage ELVSS through the OLED, based on an image data signal received via the data line Di. The OLED emits light having a brightness corresponding to the image data signal.

The scan driving unit 20 generates a scan signal and a gate signal and transfers the scan signal and the gate signal to each of the scan lines S1 through Sn and each of the gate lines G1 through Gn. The sensing driving unit 40 generates a sensing signal and transfers the sensing signal to each of the sensing lines SE1 through SEn.

The data driving unit 30 transfers an image data signal Data2 to each of the data lines D1 through Dm. A plurality of image data signals Data2 are generated by changing a plurality of image signals Data1 transferred from the outside and transferring the changed plurality of image signals Data1 to the data driving unit 30, via the controlling unit 50. The data driving unit 30 may transfer a source data signal to each of the data lines D1 through Dm as a test for sensing an operation point of the driving transistor.

The sensing unit 70 senses a current flowing from the driving transistor of the pixel PX. To sense the operation point of the driving transistor of the pixel PX, the sensing unit 70 may apply a reference voltage to the first node N1 of the pixel PX and may sense the current flowing from the driving transistor. The sensing unit 70 may be connected to the pixels PX through the data lines D1 through Dm and the switching unit 80 or may be connected to the pixels PX through the additional connection lines B1 through Bm.

The sensing unit 70 senses a first current which flows from the driving transistor in a state in which the first reference voltage is applied to the first node N1, and a second current which flows from the driving transistor in a state in which the second reference voltage is applied to the first node N1, when a first source data signal, corresponding to a first gray level, is transferred to the pixel PX.

The first source data signal is a test signal for sensing the operation point of the driving transistor of the pixel PX, and may be transferred to the pixels PX through the data lines D1 through Dm via the data driving unit 30. The first source data signal may have a voltage level corresponding to the first gray level, and when the first source data signal is transferred to the pixel PX through the data line Di, the pixel PX emits light having a brightness corresponding to the first gray level. The first gray level may be at least one selected from within a range from gray level 1 to gray level 255, when image data is 8 bits. For example, the first gray level may be at least one selected from gray level 255, gray level 128, gray level 64, gray level 32, and gray level 16. The first source data signal may determine a source-gate voltage of the driving transistor. The driving transistor of the pixel PX may output a current corresponding to the first gray level, in response to the first source data signal.

The sensing unit 70 may apply the first reference voltage to the first node N1 of the pixel PX and may sense the first current flowing from the driving transistor. Also, the sensing unit 70 may apply the second reference voltage to the first node N1 of the pixel PX and may sense the second current flowing from the driving transistor. The second reference voltage has a level different from that of the first reference voltage. When the first reference voltage or the second reference voltage is applied to the first node N1, a source-drain voltage of the driving transistor and a voltage across the OLED may be determined.

When the first reference voltage is applied to the first node N1, the source-drain voltage of the driving transistor may be determined as a difference between the first power voltage ELVDD and the first reference voltage, and the voltage across the OLED may be determined as a difference between the first reference voltage and the second power voltage ELVSS. When the second reference voltage is applied to the first node N1, the source-drain voltage of the driving transistor may be determined as a difference between the first power voltage ELVDD and the second reference voltage, and the voltage across the OLED may be determined as a difference between the second reference voltage and the second power voltage ELVSS.

The sensing unit 70 may apply the first reference voltage to the first node N1 and may sense the first current of the driving transistor, and the sensing unit 70 may apply the second reference voltage to the first node N1 and may sense the second current of the driving transistor, in response to a sense signal output from the sensing driving unit 40.

The switching unit 80 may selectively connect the data lines D1 through Dm to either the data driving unit 30 or the sensing unit 70. For example, when the display unit 10 has to display an image, the switching unit 80 may connect the data lines D1 through Dm to the data driving unit 30 so that the image data signal Data2 is applied to the pixels PX. Also, the switching unit 80 may connect the data lines D1 through Dm to the data driving unit 30 to transfer the first source data signal to the pixels PX during a test operation. The switching unit 80 may connect the data lines D1 through Dm to the sensing unit 70 so that a current of the driving transistor may be sensed by the sensing unit 70.

The switching unit 80 may include a plurality of pairs of switching devices and each pair of switching devices may be connected to each of the data lines D1 through Dm. However, this is only an exemplary embodiment. Since the sensing unit 70 may measure the current of the driving transistor by selecting some pixels PX among the pixels PX of the display unit 10, the switching devices may be connected to some of the data lines D1 through Dm.

The point in time in which the sensing unit 70 senses the current of the driving transistor of the pixels PX is not necessarily limited. However, the current of the driving transistor may be sensed whenever power is applied to the organic light-emitting display apparatus 100, or before the organic light-emitting display apparatus 100 is shipped as a product. In other embodiments, the sensing unit 70 may periodically operate automatically. In yet other embodiments, the sensing unit 70 may be set to operate by a user's setting.

The memory 95 stores current-voltage information of the OLED of the pixel PX. The current-voltage information of the OLED is information about a voltage applied to respective electrodes of the OLED and a current flowing through the OLED. When a voltage that is higher than a threshold voltage is applied across the OLED, the current starts to flow through the OLED and the OLED emits light.

The driving current determination unit 90 generates characteristic information of the driving transistor of the pixel PX based on the first current and the second current sensed by the sensing unit 70. The first current is a current that is output from the driving transistor when the first source data signal, corresponding to the first gray level, is transferred to the pixel PX and the first reference voltage is applied to the first node N1 of the pixel PX. The second current is a current that is output from the driving transistor when the first source data signal, corresponding to the first gray level, is transferred to the pixel PX and the second reference voltage is applied to the first node N1 of the pixel PX. The first current and the second current may be transferred to the sensing unit 70 through the data lines D1 through Dm via the switching unit 80. In other embodiments, the first current and the second current may be transferred to the sensing unit 70 through the additional connection lines.

Ideally, the driving transistor of the pixel PX has to output a constant current corresponding to the first gray level, in response to the first source data signal. That is, when the driving transistor operates in a saturated region, even if the source-drain voltage of the driving transistor changes, a constant volume of current, which is determined by a gate-source voltage, has to flow from the driving transistor. However, in reality, the current flowing from the driving transistor is affected by the source-drain voltage. When the source-drain voltage becomes higher, the current flowing from the driving transistor becomes higher. This phenomenon is known as channel-length modulation.

When the sensing unit 70 applies the first reference voltage to the first node N1, the source-drain voltage of the driving transistor is determined, and here the first current output from the driving transistor is different from the second current when the second reference voltage is applied. The first current when the first reference voltage is applied to the first node N1 and the second current when the second reference voltage is applied to the first node N1 are related to the characteristic information of the driving transistor. The characteristic information may include a channel-length modulation parameter when the driving transistor operates in the saturated region.

The driving current determination unit 90 determines the driving current of the driving transistor, corresponding to the first gray level, based on the characteristic information of the driving transistor and the current-voltage information of the OLED. Also, the driving current determination unit 90 may determine a voltage of the first node N1 when the first source data signal is transferred to the pixel PX.

In this method, the organic light-emitting display apparatus 100 according to the present embodiment may determine the driving current that the driving transistor supplies to the OLED, with respect to various suitable gray levels other than the first gray level.

In other embodiments, the sensing unit 70 and the driving current determination unit 90 may determine the driving current with respect to other gray levels more easily, by using the characteristic information of the driving transistor, generated in the process of determining the driving current with respect to the first gray level. The sensing unit 70 may sense a third current flowing from the driving transistor in a state in which a third reference voltage is applied to the first node N1, when a second source data signal, corresponding to a second gray level that is different from the first gray level, is transferred to the pixel PX. Here, the third reference voltage may have the same or substantially the same level as the first reference voltage or the second reference voltage. The driving current determination unit 90 may determine the driving current of the driving transistor, corresponding to the second gray level, based on the third current when the third reference voltage is applied, the characteristic information of the driving transistor, and the current-voltage information of the OLED.

The organic light-emitting display apparatus 100 may accurately calculate the driving current with respect to each gray level. The organic light-emitting display apparatus 100 may display a more precise image by amending the image signal Data1 and the image data signal Data2 based on the driving current, corresponding to each gray level, which is accurately calculated.

Although the driving current determination unit 90 and the memory 95 are illustrated as separate devices in FIG. 1, it is not limited thereto. The driving current determination unit 90 and the memory 95 may be included in the controlling unit 50 or the sensing unit 70.

The controlling unit 50 may generate and transfer a plurality of control signals controlling the scan driving unit 20, the data driving unit 30, the sensing driving unit 40, the sensing unit 70, the switching unit 80, and the driving current determination unit 90.

The controlling unit 50 may transfer a scan driving control signal SCS to the scan driving unit 20, and the scan driving control signal SCS may control the scan driving unit 20 to supply a scan signal to each of the scan lines S1 through Sn. The scan driving control signal SCS may also control the scan driving unit 20 to supply a gate signal to each of the gate lines G1 through Gn.

The controlling unit 50 may transfer a data driving control signal DCS to the data driving unit 30, and the data driving control signal DCS may control the data driving unit 30 to supply the corresponding image data signal Data2 and the source data signal to each of the data lines D1 through Dm.

The controlling unit 50 may transfer a sensing driving control signal SECS to the sensing driving unit 40, and the sensing driving control signal SECS may control the sensing driving unit 40 to supply a sensing signal to each of the sensing lines SE1 through SEn.

The controlling unit 50 may transfer a sensing control signal TCS and a switching control signal SWCS to the sensing unit 70 and the switching unit 80, respectively. The sensing control signal TCS may control the sensing unit 70 to output a reference voltage and sense the current flowing from the driving transistor. The switching control signal SWCS may control a turn-on operation of the plurality of pairs of switching devices of the switching unit 80 which selectively connects the sensing unit 70 and the data driving unit 80 to the data lines D1 through Dm.

Figure 2:
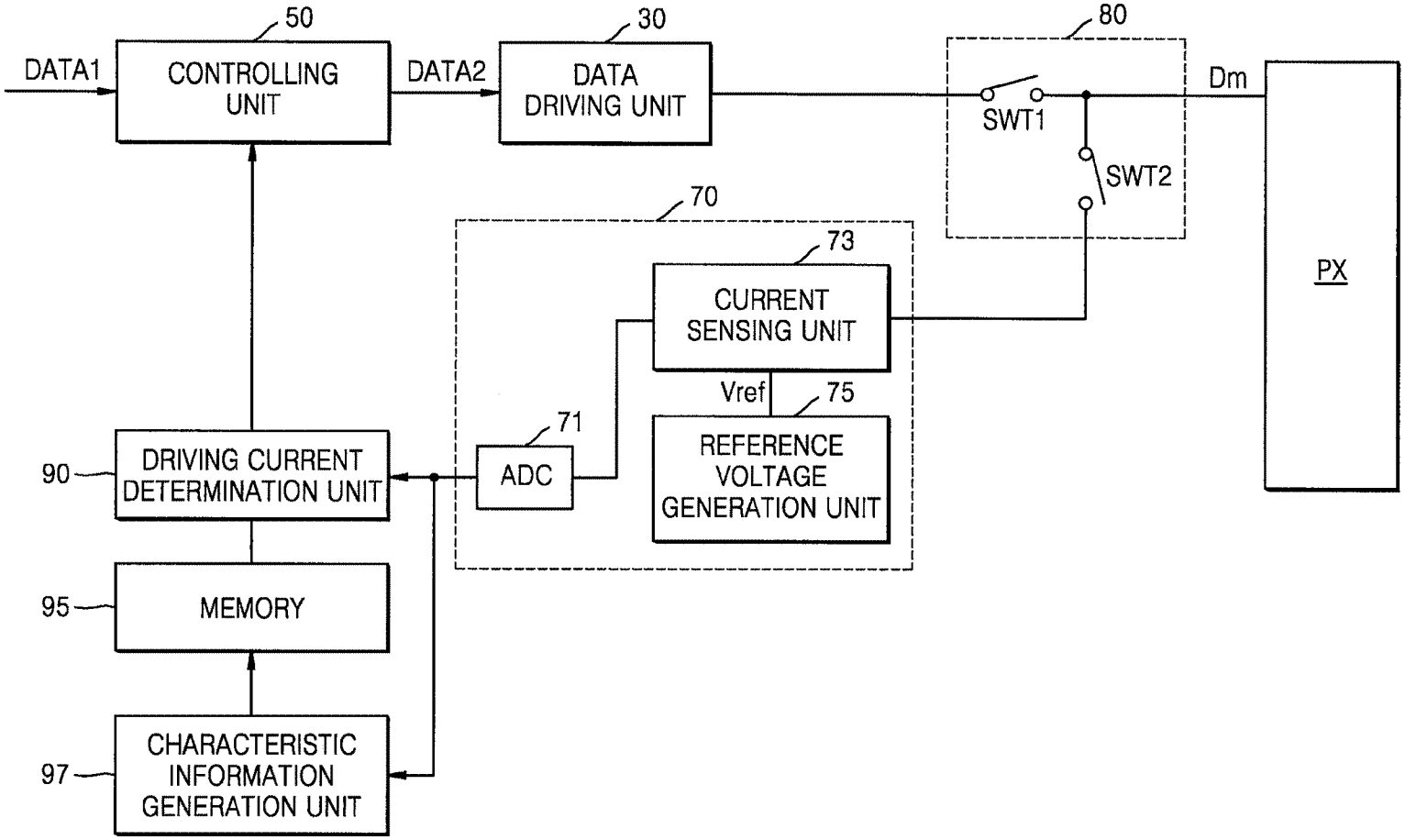
FIG. 2 is a block diagram illustrating in detail elements of the organic light-emitting display apparatus of FIG. 1.

FIG. 2 is a block diagram illustrating in detail elements of the organic light-emitting display apparatus 100 of FIG. 1.

Elements of the organic light-emitting display apparatus 100 illustrated in FIG. 1 other than the sensing unit 70 and the switching unit 80 are described with reference to FIG. 1, and thus, their descriptions may be omitted. FIG. 2 illustrates the sensing unit 70 and the switching unit 80 connected to an $m^{th}$ data line Dm connected to the pixel PX included in an $m^{th}$ pixel column.

Referring to FIG. 2, the sensing unit 70 includes an analog-digital converter (hereinafter, referred to as "ADC") 71, a current sensing unit 73, and a reference voltage generation unit (or a reference voltage generator) 75.

The reference voltage generation unit 75 generates a reference voltage Vref that is to be applied to the first node N1 of the pixel PX. As illustrated in FIG. 2, the reference voltage Vref may be provided to the current sensing unit 73. The reference voltage generation unit 75 may be realized as various suitable types of circuits which make a voltage level of the first node N1 the same or substantially the same as a level of the reference voltage Vref. The reference voltage generation unit 75 may change the level of the reference voltage Vref according to a control of the controlling unit 50.

The reference voltage Vref having a first level is referred to as a first reference voltage Vref1 and the reference voltage Vref having a second level that is different from the first level is referred to as a second reference voltage Vref2.

The current sensing unit 73 is a sensing circuit which senses the current output from the driving transistor of the pixel PX. The current sensing unit 73 may sense the current output from the driving transistor of the pixel PX by being connected to the data line Dm via the switching unit 80. The current sensed by the current sensing unit 73 may be transferred to the ADC 71 and the ADC 71 may convert the current output from the driving transistor of the pixel PX into a digital value.

The pixel PX receives the first source data signal corresponding to the first gray level and the driving transistor outputs the current corresponding to the first source input data signal in the current sensing unit 73 through the data line Dm. Here, the switching unit 80 connects the data line Dm to the data driving unit 30 so that the first source data signal is transferred from the data driving unit 30 to the pixel PX, and connects the data line Dm to the sensing unit 70 so that the current output from the driving transistor is transferred to the current sensing unit 73. As such, the data driving unit 30 and the sensing unit 70 share the data line Dm through the switching unit 80, and thus, designing of circuit wirings may become simple (or easier).

The switching unit 80 includes a first selection switch SWT1 and a second selection switch SWT2. The first selection switch SWT1 is connected to the data driving unit 30, and transfers the image data signal Data2 according to an external image signal or a test source data signal to the pixel PX through the data line Dm, when turned on. The second selection switch SWT2 is connected to the current sensing unit 73 of the sensing unit 70, and transfers the current output from the driving transistor of the pixel PX to the current sensing unit 70 through the data line Dm, when being turned on.

In some embodiments, the current sensing unit 73 may be realized as an integrator circuit using an operational amplifier. The reference voltage Vref supplied from the reference voltage generation unit 75 may be applied to a first input terminal of the operational amplifier, and an output terminal of the operational amplifier may be connected to the ADC 71. A second input terminal of the operational amplifier may be connected to the data line Dm via the switching unit 80, and a capacitor may be connected between the second input terminal and the output terminal of the operational amplifier. The current sensing unit 73 may apply the reference voltage Vref to the data line Dm, and the current flowing through the data line Dm may be calculated based on a difference between a voltage of the output terminal and the reference voltage Vref.

Although it is not illustrated in FIG. 2, the sensing unit 70 may further include a storage unit, and the storage unit may store digital data obtained by the ADC 71.

In other embodiments, the organic light-emitting display apparatus 100 may further include a characteristic information generation unit 97. The characteristic information generation unit 97 may generate the current-voltage information of the OLED of the pixel PX, the information to be stored in the memory 95 by using the sensing unit 70. The sensing unit 70 may apply the reference voltage Vref to the first node N1 and may sense an emission current flowing through the OLED. The current-voltage information of the OLED may be generated by sensing the emission current by changing the reference voltage Vref.

Figure 3:
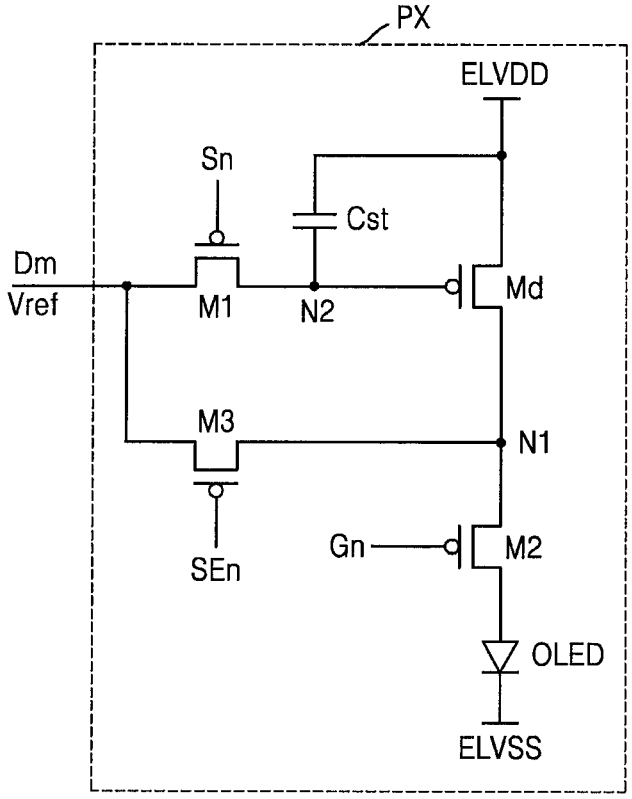
FIG. 3 is a circuit diagram of an example of a pixel of an organic light-emitting display apparatus according to an embodiment.

FIG. 3 is a circuit diagram of an example of a pixel of an organic light-emitting display apparatus according to an embodiment.

For convenience of explanation, FIG. 3 illustrates the circuit diagram of the pixel PX located in an $n^{th}$ pixel line and an $m^{th}$ pixel column among the pixels PX of the display unit 10. Thus, the pixel PX of FIG. 3 is connected to an $n^{th}$ scan line Sn, an $n^{th}$ gate line Gn, an $n^{th}$ sensing line SEn, and an $m^{th}$ data line Dm. The pixel PX receives an image data signal and a source data signal through the data line Dm. Also, the pixel PX receives the reference voltage Vref through the data line Dm.

The pixel PX according to the present embodiment includes an OLED, a driving transistor Md, a switching transistor M1, a connection transistor M2, a sensing transistor M3, and a storage capacitor Cst. The pixel PX includes a first node N1 to which the driving transistor Md and the connection transistor M2 are connected and a second node N2 to which a gate of the driving transistor Md is connected.

The pixel PX includes the driving transistor Md for transferring a driving current to the OLED, and the OLED emits light when the driving current flows into an anode electrode.

The driving transistor Md is located between the anode electrode of the OLED and a first power voltage ELVDD and controls a current flowing from the first power voltage ELVDD to a second power voltage ELVSS through the OLED.

A gate electrode of the driving transistor Md is connected to the second node N2, a first electrode of the driving transistor Md is connected to the first power voltage ELVDD, and a second electrode of the driving transistor Md is connected to the first node N1. The gate electrode and the first electrode of the driving transistor Md are connected to respective electrodes of the storage capacitor Cst and control the driving current flowing from the first power voltage ELVDD to the OLED in correspondence to a voltage level according to a data signal stored in the storage capacitor Cst. Here, the OLED emits light in a brightness corresponding to a volume of the driving current supplied from the driving transistor Md.

A gate electrode of the switching transistor M1 is connected to the $n^{th}$ scan line Sn, a first electrode of the switching transistor M1 is connected to the $m^{th}$ data line Dm, and a second electrode of the switching transistor M1 is connected to the second node N2. The switching transistor M1 transfers a data signal D[m] transferred through the $m^{th}$ data line Dm to the second node N2, in response to a scan signal S[n] transferred through the $n^{th}$ scan line Sn. The storage capacitor Cst, an electrode of which is connected to the second node N2, stores a voltage level according to a difference between a voltage corresponding to the data signal D[m] applied to the second node N2 and the first power voltage ELVDD to which the other electrode of the storage capacitor Cst is connected, for a period (e.g., a predetermined period).

A gate electrode of the connection transistor M2 is connected to the $n^{th}$ gate line Gn, a first electrode of the connection transistor M2 is connected to the first node N1, and a second electrode of the connection transistor M2 is connected to the anode electrode of the OLED. The connection transistor M2 connects the driving transistor Md and the OLED in response to a gate signal G[n] transferred through the $n^{th}$ gate line Gn. The connection transistor M2 separates the driving transistor Md and the OLED while the sensing unit 70 senses the current output from the driving transistor Md, so that the current output from the driving transistor Md does not flow into the OLED and is transferred to the sensing unit 70 via the sensing transistor M3.

A gate electrode of the sensing transistor M3 is connected to the $n^{th}$ sensing line SEn, a first electrode of the sensing transistor M3 is connected to the first node N1, and a second electrode of the sensing transistor M3 is connected to the $m^{th}$ data line Dm. The sensing transistor M3 transfers the current flowing through the first node N1 to the sensing unit 70 through the data line Dm, in response to a sensing signal SE[n] transferred through the $n^{th}$ sensing line SEn. Also, the sensing transistor M3 applies the reference voltage Vref, applied from the sensing unit 70, to the first node N1 through the data line Dm, in response to the sensing signal SE[n] transferred through the $n^{th}$ sensing line SEn.

In detail, the switching unit 80 connects the data line Dm to the data driving unit 30, and a voltage level corresponding to a source data signal, transferred from the data driving unit 30, is stored in the capacitor Cst. The switching unit 80 connects the data line Dm to the sensing unit 70, and the sensing unit 70 applies the reference voltage Vref to the first node N1 through the data line Dm and the sensing transistor M3. A source-drain voltage of the driving transistor Md is determined as a difference between the first power voltage ELVDD and the reference voltage Vref, and a gate-source voltage of the driving transistor Md is determined as a voltage stored in the capacitor Cst. The driving transistor Md generates a current corresponding to the source data signal in a state in which the reference voltage Vref is applied to the first node N1. The current generated in the driving transistor Md is transferred to the sensing unit 70 through the first node N1, the sensing transistor M3, and the data line Dm, and the sensing unit 70 senses the current. The current sensing unit 73 transfers the current to the ADC 71, and the ADC 71 converts the current into a corresponding digital value. The controlling unit 50 controls the sensing unit 70 such that the reference voltage Vref supplied by the sensing unit 70 has different levels and a first reference voltage Vref1 and a second reference voltage Vref2 are each applied to the first node N1.

Accordingly, the sensing unit 70 may sense a first current flowing from the driving transistor Md in a state in which the first reference voltage Vref1 is applied to the first node N1, and a second current flowing from the driving transistor Md in a state in which the second reference voltage Vref2 is applied to the first node N1, when a first source data signal, corresponding to a first gray level, is transferred to the pixel PX.

FIG. 3 illustrates the transistors forming the pixel PX as PMOS type transistors. However, the transistors are not limited thereto. The transistors may be realized as NMOS type transistors. Also, the pixel PX of FIG. 3 is illustrated as an example. The present inventive concept may also be applied to pixels having different structures, in addition to the pixel PX of FIG. 3.

Figure 4:
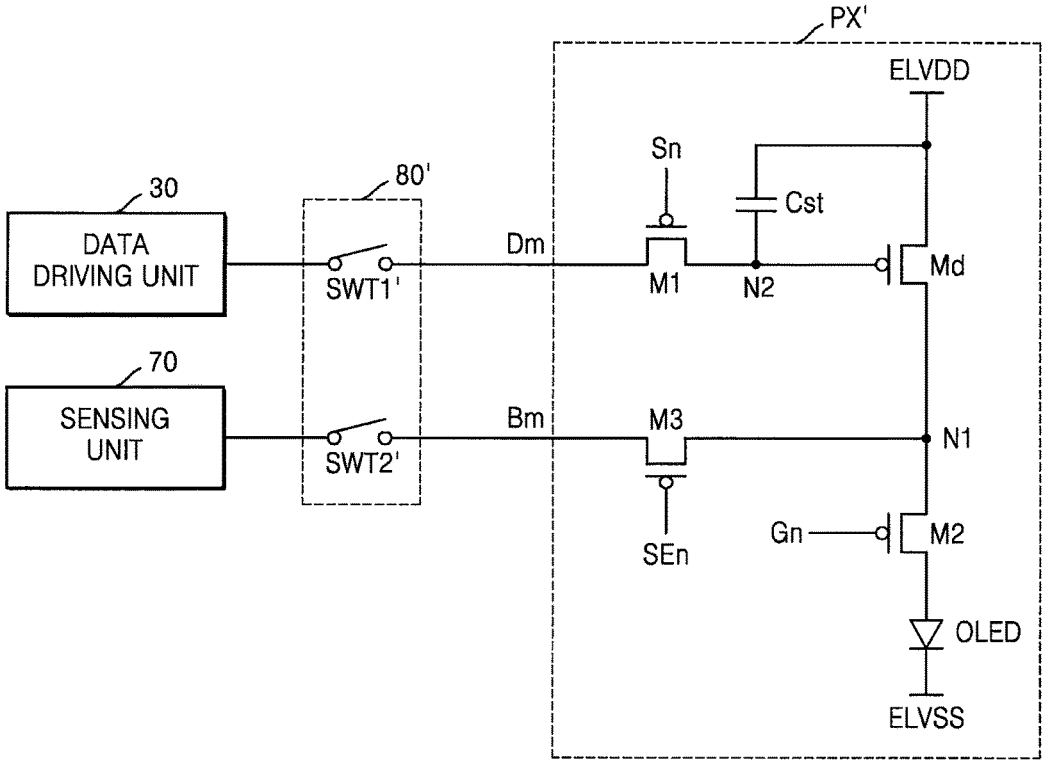
FIG. 4 is a block diagram of some elements of an organic light-emitting display apparatus according to another embodiment.

FIG. 4 is a block diagram of some elements of an organic light-emitting display apparatus according to another embodiment.

Referring to FIG. 4, the data driving unit 30, the sensing unit 70, a switching unit 80' according to another embodiment and a pixel PX' according to another embodiment are illustrated. Except the switching unit 80' and the pixel PX', other elements are described with reference to FIG. 1, and thus, their descriptions may be omitted.

The pixel PX' illustrated in FIG. 4 is connected to an $n^{th}$ scan line Sn, an $n^{th}$ gate line Gn, an $n^{th}$ sensing line SEn, an $m^{th}$ data line Dm, and an $m^{th}$ connection line Bm. The pixel PX receives an image data signal and a source data signal through the data line Dm, the current output from the driving transistor Md is transferred to the sensing unit 70 through the connection line Bm, and the reference voltage Vref supplied from the sensing unit 70 is applied to the first node N1 through the connection line Bm.

The switching unit 80' includes a first selection switch SWT1' for connecting the data driving unit 30 and the data line Dm, and a second selection switch SWT2' for connecting the sensing unit 70 and the connection line Bm. When the image data signal and the source data signal provided from the data driving unit 30 are supplied to the pixel PX through the data line Dm, the first selection switch SWT1' is closed and the second selection switch SWT'2 is opened. When the current output from the driving transistor Md is transferred to the sensing unit 70 through the connection line Bm, or the reference voltage Vref supplied from the sensing unit 70 is applied to the first node N1 through the connection line Bm, the second selection switch SWT'2 is closed.

FIGS. 5 through 8 are views for describing an organic light-emitting display apparatus and a method of driving the same, according to an embodiment.

Figure 5:
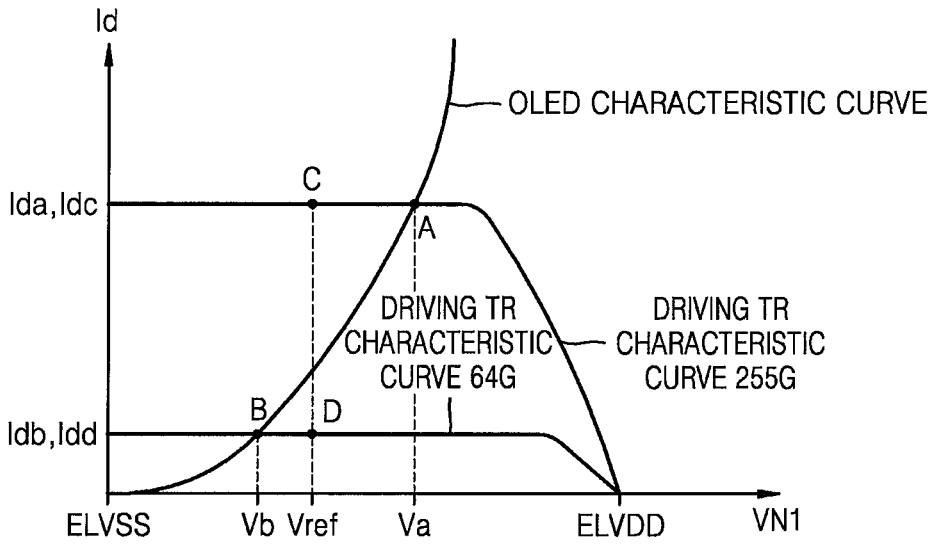
FIG. 5 illustrates a characteristic curve of an ideal driving transistor and a characteristic curve of an organic light-emitting diode.

FIG. 5 illustrates a characteristic curve of an ideal driving transistor and a characteristic curve of an OLED.

For example, a first characteristic curve (a driving TR characteristic curve 255G) of the driving transistor when a first source data signal, corresponding to gray level 255, is transferred to the pixel PX and a second characteristic curve (a driving TR characteristic curve 64G) of the driving transistor when a second source data signal, corresponding to gray level 64, is transferred to the pixel PX, are illustrated. Also, a characteristic curve of the OLED (an OLED characteristic curve) of the pixel PX is illustrated.

When the first source data signal, corresponding to gray level 255, is transferred to the pixel PX, point A in which the first characteristic curve of the driving transistor and the characteristic curve of the OLED meet becomes a driving point. That is, when the first source data signal, corresponding to gray level 255, is transferred to the pixel PX, a voltage Va of the first node N1 between the driving transistor and the OLED and a current Ida flowing through the first node N1, may be indicated as point A. Also, when the second source data signal, corresponding to gray level 64, is transferred to the pixel PX, point B in which the second characteristic curve of the driving transistor and the characteristic curve of the OLED meet becomes a driving point. That is, when the second source data signal, corresponding to gray level 64, is transferred to the pixel PX, a voltage Vb of the first node N1 and a current Idb flowing through the first node N1 may be indicated as point B.

The driving transistor outputs a constant current Id in a saturated region. The current may be referred to as a drain current Id or a driving current of the driving transistor. Even when a voltage VN1 of the first node N1 is changed, the drain current Id does not change if the driving transistor is in the saturated region.

Thus, the current Id that is sensed when the sensing unit 70 generates the reference voltage Vref and the reference voltage Vref is applied to the first node N1, according to the present embodiments, is the same or substantially the same as a current of the driving point. For example, when the first source data signal, corresponding to gray level 255, is transferred to the pixel PX, the sensing unit 70 applies the reference voltage Vref to the first node N1 and senses a current Idc at point C. The current Idc at point C is the same or substantially the same as the current Ida at point A. Thus, even if the reference voltage Vref is different from the voltage Va at point A, the current Ida output from the driving transistor when the first source data signal, corresponding to gray level 255, is transferred to the pixel PX may be accurately sensed. Also, when the second source data signal, corresponding to gray level 64, is transferred to the pixel PX, a current Idd at point D is the same or substantially the same as the current Idb at point B. Thus, even if the reference voltage Vref is different from the voltage Vb at point B, the current Idb output from the driving transistor when the second source data signal, corresponding to gray level 64, is transferred to the pixel PX may be accurately sensed.

However, the driving transistor of the organic light-emitting display apparatus is not ideal, and the drain current Id of the driving transistor changes according to a source-drain voltage of the driving transistor.

Figure 6:
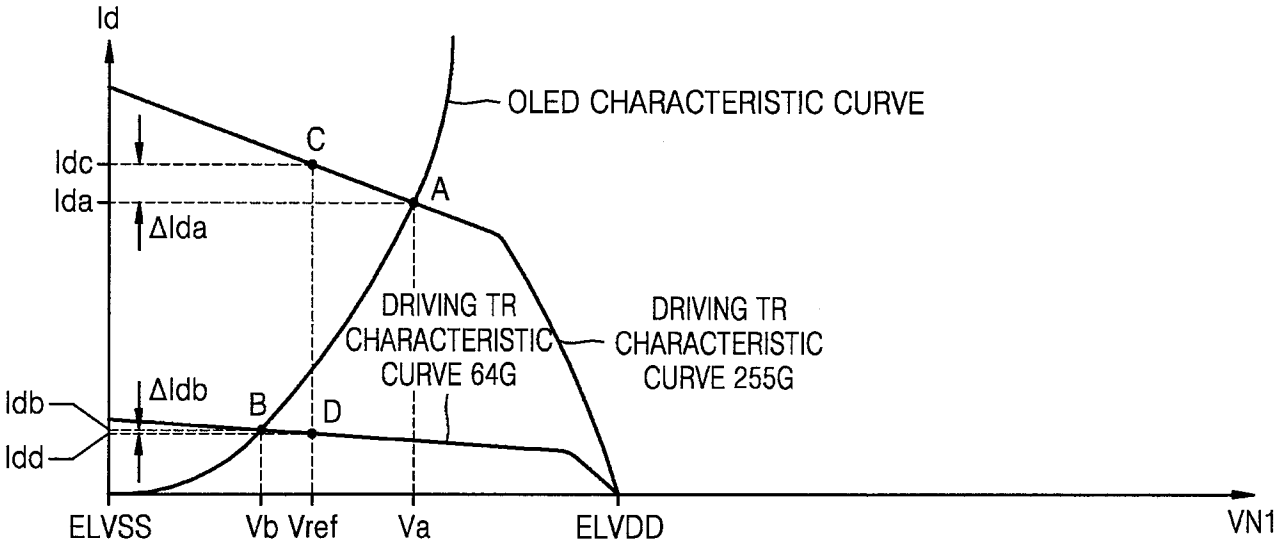
FIG. 6 illustrates a characteristic curve of a general driving transistor and a characteristic curve of an organic light-emitting diode.

FIG. 6 illustrates a characteristic curve of a general driving transistor and a characteristic curve of an OLED.

As illustrated in FIG. 6, the higher the source-drain voltage of the driving transistor is, the higher the drain current Id of the driving transistor is. This phenomenon is known as channel-length modulation. When the source-drain voltage of the driving transistor becomes higher, a channel between a source region and a drain region becomes short, and thus, a depletion region is increased and the increased depletion region functions as an output resistor.

Accordingly, when the reference voltage Vref applied to the first node N1 is lower than a voltage of the driving point, a current higher than an actual drain current is sensed, and when the reference voltage Vref applied to the first node N1 is higher than the voltage of the driving point, a current lower than the actual drain current is sensed.

For example, when the first source data signal, corresponding to gray level 255, is transferred to the pixel PX, the sensing unit 70 applies the reference voltage Vref to the first node N1 and senses the current Idc at point C. The current Idc at point C is higher than the current Ida at point A that is the actual driving point. Also, when the second source data signal, corresponding to gray level 64, is transferred to the pixel PX, the sensing unit 70 applies the reference voltage Vref to the first node N1 and senses the current Idd at point D. Here, the current Idd at point D is lower than the current Idb at point B.

The organic light-emitting display apparatus performs compensation based on the drain current sensed with respect to the source data signal corresponding to each gray level, in order to display an accurate brightness and color. However, when the drain current with respect to the source data signal, corresponding to each gray level, is not accurately sensed, over-compensation or under-compensation may be performed, and thus, the accurate color display becomes very difficult or impossible.

Figure 7:
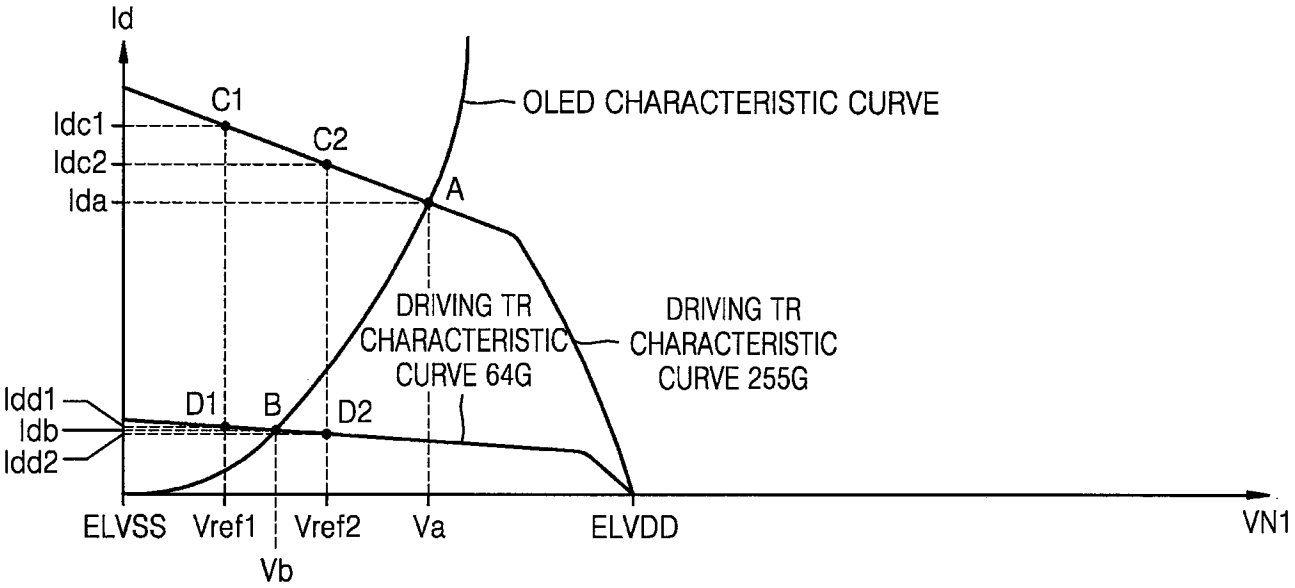
FIG. 7 illustrates a characteristic curve of a driving transistor and a characteristic curve of an organic light-emitting diode according to a method of driving an organic light-emitting display apparatus according to an embodiment.

FIG. 7 illustrates a characteristic curve of the driving transistor and a characteristic curve of the OLED for describing a method of driving the organic light-emitting display apparatus 100.

As illustrated in FIG. 7, when the first source data signal, corresponding to a first gray level (for example, gray level 255), is transferred to the pixel PX, the driving transistor outputs the drain current Id according to the first characteristic curve (the driving TR characteristic curve 255G) according to the voltage VN1 of the first node N1.

According to the present embodiment, the data driving unit 30 transfers the first source data signal, corresponding to the first gray level, to the pixel PX. To this end, a scan signal is transferred to the switching transistor M1 through the scan line Sn at a gate-on voltage level (for example, a low level). The switching transistor M1 is turned-on in response to the scan signal. The data driving unit 30 is synchronized by the scan signal and outputs the first source data signal in the data line Dm. Here, the switching unit 80 connects the data line Dm to the data driving unit 30. The first source data signal is applied to the second node N2, and a voltage difference between the first power voltage ELVDD and a voltage of the first source data signal is stored in the capacitor Cst. When the voltage, corresponding to the first source data signal, is stored in the capacitor Cst, the switching transistor M1 may be turned-off in response to the scan signal of a gate-off voltage level (for example, a high level).

Then, the switching unit 80 connects the data line Dm to the sensing unit 70. The sensing unit 70 generates the first reference voltage Vref1 and applies the first reference voltage Vref1 to the first node N1 through the data line Dm and the sensing transistor M3. Here, the sensing transistor M3 is turned-on in response to a sensing signal of a gate-on voltage level (for example, a low level). The connection transistor M2 is turned-off in response to a gate signal of a gate-off voltage level (for example, a high level). The driving transistor Md generates a first drain current Idc1 according to the first reference voltage Vref1 applied to the first node N1 and the voltage stored in the capacitor Cst. The source-drain voltage of the driving transistor Md corresponds to a difference between the first power voltage ELVDD and the first reference voltage Vref1, and the source-gate voltage of the driving transistor Md corresponds to a voltage difference between the first power voltage ELVDD and the voltage of the first source data signal, the voltage difference being stored in the capacitor Cst. The first drain current Idc1 is transferred to the sensing unit 70 through the sensing transistor M3 and the data line Dm. The sensing unit 70 senses the first drain current Idc1, and provides a first current value, corresponding to the first drain current Idc1, to the driving current determination unit 90. The sensing unit 70 may apply the first reference voltage Vref1 to the first node N1 and sense the first drain current Idc1, in response to the sensing signal of the gate-on voltage level (for example, the low level).

Also, the sensing unit 70 generates the second reference voltage Vref2 that is different from the first reference voltage Vref1 and applies the second reference voltage Vref2 to the first node N1 through the data line Dm and the sensing transistor M3. The driving transistor Md generates a second drain current Idc2 according to the second reference voltage Vref2 applied to the first node N1 and the voltage stored in the capacitor Cst. The source-drain voltage of the driving transistor Md corresponds to a difference between the first power voltage ELVDD and the second reference voltage Vref2, and the source-gate voltage of the driving transistor Md corresponds to a voltage difference between the first power voltage ELVDD and the voltage of the first source data signal, the voltage difference being stored in the capacitor Cst. The second drain current Idc2 is transferred to the sensing unit 70 through the sensing transistor M3 and the data line Dm. The sensing unit 70 senses the second drain current Idc2 and provides a second current value, corresponding to the second drain current Idc2, to the driving current determination unit 90. The sensing unit 70 may apply the second reference voltage Vref2 to the first node N1 and sense the second drain current Idc2, in response to the sensing signal of the gate-on voltage level (for example, the high level).

The driving current determination unit 90 may receive information about the first drain current Idc1 when the first source data signal, corresponding to the first gray level (for example, gray level 255), is transferred to the pixel PX and the first reference voltage Vref1 is applied to the first node N1. That is, the driving current determination unit 90 may receive information about point C1 of FIG. 7. The driving current determination unit 90 may receive information about the second drain current Idc2 when the first source data signal, corresponding to the first gray level (for example, gray level 255), is transferred to the pixel PX and the second reference voltage Vref2 is applied to the first node N1. That is, the driving current determination unit 90 may receive information about point C2 of FIG. 7.

As illustrated in FIG. 7, the driving transistor Md has a higher drain current as the source-drain voltage is increased in a saturated region, and the relationship between the source-drain voltage and the drain current may be represented by using a linear function. Thus, based on the relationship between the source-drain voltage and the drain current, the driving current determination unit 90 may identify that the drain current is sensed as the current Ida at point A, when the sensing unit 70 applies the voltage Va at point A as the reference voltage Vref. Such a relationship between the source-drain voltage and the drain current may be referred to as characteristic information of the driving transistor and may be represented by using a channel-length modulation parameter when the driving transistor operates in a saturated region.

As described above with reference to FIG. 1, the current-voltage information of the OLED is stored in the memory 95. The current-voltage information of the OLED may be information with respect to the OLED characteristic curve of FIG. 7. The driving current determination unit 90 may determine the driving point (point A) when the first source data signal, corresponding to the first gray level (for example, gray level 255), is transferred to the pixel PX, that is, the voltage Va and the drain current Ida, based on the current-voltage information of the OLED, stored in the memory 95, that is, based on the OLED characteristic curve of FIG. 7 and the characteristic information of the driving transistor. The driving point (point A) indicates the current that the driving transistor Md of the pixel PX supplies to the OLED and the voltage of the first node N1, when the first source data signal, corresponding to the first gray level (for example, gray level 255), is transferred to the pixel PX.

According to the present embodiment, after the second source data signal, corresponding to the second gray level (for example, gray level 64) that is different from the first gray level (for example, gray level 255), is transferred to the pixel PX, the process above may be performed so that the driving point of the pixel PX when the second source data signal, corresponding to the second gray level (for example, gray level 64), is transferred to the pixel PX may be sensed. For example, the sensing unit 70 may apply the first reference voltage Vref1 and may sense the first drain current Idd1, and may again apply the second reference voltage Vref2 and may sense the second drain current Idd2, when the second source data signal, corresponding to the second gray level (for example, gray level 64), is transferred to the pixel PX. The driving current determination unit 90 may generate the characteristic curve of the driving transistor in a saturated state when the second source data signal, corresponding to the second gray level (for example, gray level 64), is transferred to the pixel PX, based on points D1 and D2 of FIG. 7. The driving current determination unit 90 may determine a driving point (that is, point B) when the second source data signal is transferred to the pixel PX, based on the generated characteristic curve of the driving transistor and the characteristic curve of the OLED. Here, the driving current of the pixel PX corresponds to the current Idb of point B.

The source data signal may be changed in this method and the driving point corresponding to each gray level may be sensed.

According to the inventive concept, the current supplied to the OLED of the pixel PX when a data signal of a particular gray level is applied to the pixel PX may be accurately sensed. Individual characteristics of the pixel PX, for example, a degree of deterioration may be accurately identified based on the current. The controlling unit 50 may correct image data by reflecting the characteristics of the pixel PX or adjust levels of the first power voltage ELVDD and/or the second power voltage ELVSS.

In other embodiments, the current-voltage information of the OLED stored in the memory 95 may be generated by using the sensing unit 70. The data driving unit 30 may apply a data signal (for example, a source data signal corresponding to gray level 0) which may turn off the driving transistor Md of the pixel PX to turn off the driving transistor Md. The sensing unit 70 may apply the reference voltage Vref to the first node N1, and the scan driving unit 20 may apply a gate signal of a gate-on voltage level (for example, a low level) to the connection transistor M2 of the pixel PX so that the first node N1 and the OLED are connected to each other. Also, the sensing driving unit 40 may apply a sensing signal of a gate-on voltage level (for example, a low level) to the sensing transistor M3 of the pixel PX so that the reference voltage Vref is applied to the first node N1.

When the reference voltage Vref is applied to the first node N1, a difference between the reference voltage Vref and the second power voltage ELVSS is applied across the OLED, and here the emission current flowing through the OLED may be sensed by the sensing unit 70 through the sensing transistor M3. The current-voltage information of the OLED of each pixel PX, that is, the OLED characteristic information, may be generated by changing the level of the reference voltage Vref and sensing the emission current flowing through the OLED with respect to each level. The generated OLED characteristic information may be stored in the memory 95. Since the OLED characteristic information may change as the OLED deteriorates, the current-voltage information of the OLED may be renewed by using the sensing unit 70, whenever power is applied to the organic light-emitting display apparatus 100. In other embodiments, the sensing unit 70 may operate periodically or randomly by a user's setting to renew the current-voltage information of the OLED stored in the memory 95.

Figure 8:
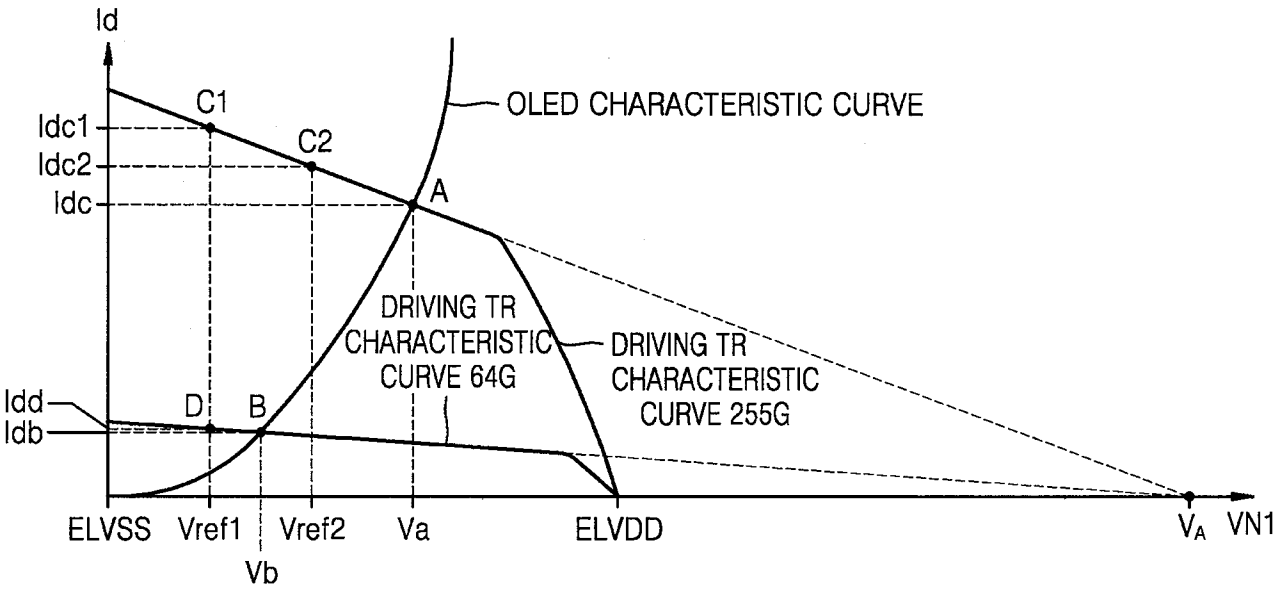
FIG. 8 illustrates a characteristic curve of a driving transistor and a characteristic curve of an organic light-emitting diode according to a method of driving an organic light-emitting display apparatus according to another embodiment.

FIG. 8 illustrates a characteristic curve of the driving transistor and a characteristic curve of the OLED for describing a method of driving an organic light-emitting display apparatus according to another embodiment.

As described above with reference to FIG. 7, the driving point (point A) when the first source data signal, corresponding to the first gray level (for example, gray level 255), is transferred to the pixel PX may be sensed. According to the present embodiment, to sense the driving point (point B) when the second source data signal, corresponding to the second gray level (for example, gray level 64) that is different from the first gray level (for example, gray level 255), is transferred to the pixel PX, the driving point is not sensed based on two points (points D1 and D2 of FIG. 7) and based on only one point (point D of FIG. 8).

Referring to FIG. 8, an extension point of the characteristic curve of the driving transistor in the saturated region when the first source data signal is transferred to the pixel PX and an extension point of the characteristic curve of the driving transistor in the saturated region when the second source data signal is transferred to the pixel PX correspond to each other. The point is represented as $V_A$ in FIG. 8.

A drain current of a p-type driving transistor operating in the saturated region may be represented as following:

$$Id=\frac{1}{2}kp'(W/L)(Vsg-|Vt|)2(1+\lambda Vsd)$$

Here, Id denotes the drain current of the driving transistor, kp' denotes μp Cox, μp denotes a silicon hole mobility, and Cox denotes a capacitance per unit region of an oxide layer.

W and L denote a channel width and a channel length of the driving transistor, respectively. Vsg denotes a source-gate voltage of the driving transistor, Vt denotes a threshold voltage of the driving transistor, and Vsd denotes a source-drain voltage of the driving transistor.

λ is a process technique parameter having a unit of $V^{-1}$, and is disproportional to the channel length with respect to a given process. λ may be referred to as a channel-length modulation parameter when the driving transistor operates in the saturated region. As illustrated in FIG. 8, the drain current Id is linearly dependent on the source-drain voltage Vsd.

When Vsd is $-1/\lambda$, the drain current Id becomes 0. $V_A$ of FIG. 8 is a voltage corresponding to $-1/\lambda$.

By using such relationship, the driving current determination unit according to the present embodiment may determine the driving point (point B) when the second source data signal is transferred to the pixel (PX), by using the characteristic information of the driving transistor, obtained by using information of points C1 and C2 sensed when the first source data signal is transferred to the pixel PX, that is, information about $V_A$, the drain current Idd in a state in which the reference voltage Vref1 is applied when the second source data signal is transferred to the pixel PX, and the characteristic information of the OLED. Although the first reference voltage Vref1 is used, in the present embodiment, a different level voltage may be used as the reference voltage.

According to the present embodiment, the reference voltage may be applied one time to determine the driving point corresponding to a different gray level (for example, the second gray level), by using the information that is sensed to determine the driving point corresponding to one gray level (for example, the first gray level), and thus, the time taken for detecting the driving point may be reduced.

As described above, according to the one or more of the above exemplary embodiments, the operation point of the driving transistor of the organic light-emitting display apparatus may be accurately detected so that an accurate color display may be possible by performing image data correction or gamma correction. Also, the driving voltage required for driving the pixel may be accurately calculated based on the operation point of the driving transistor, which is accurately detected, and based on this, an optimized driving voltage may be supplied so that power consumption of the organic light-emitting display apparatus may be reduced.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims and their equivalents.

What is claimed is:

1. An organic light-emitting display apparatus comprising:

a plurality of pixels, each comprising:

an organic light-emitting diode (OLED);

a driving transistor configured to supply a driving current to the OLED via a first node; and a sensing transistor connected to the first node;

a sensor configured to:

sense a first current flowing from the driving transistor through the sensing transistor in a state in which a first reference voltage is applied to the first node through the sensing transistor, when a first source data signal, corresponding to a first gray level, is transferred to a corresponding one of the pixels having the driving transistor and the first node; and sense a second current flowing from the driving transistor through the sensing transistor in a state in which a second reference voltage is applied to the first node through the sensing transistor, when the first source data signal is transferred to the corresponding one of the pixels;

a memory configured to store current-voltage information of the OLED; and a driving current determiner circuit configured to:

generate characteristic information of the driving transistor based on:

the first current when the first reference voltage is applied; and the second current when the second reference voltage is applied; and determine a driving current of the driving transistor, corresponding to the first gray level, based on the characteristic information of the driving transistor and the current-voltage information of the OLED.

2. The organic light-emitting display apparatus of claim 1, wherein the sensor is configured to sense a third current flowing from the driving transistor in a state in which a third reference voltage is applied to the first node, when a second source data signal, corresponding to a second gray level that is different from the first gray level, is transferred to the corresponding one of the pixels, and wherein the driving current determiner circuit is configured to determine a driving current of the driving transistor, corresponding to the second gray level, based on the third current when the third reference voltage is applied, the characteristic information of the driving transistor, and the current-voltage information of the OLED.

3. The organic light-emitting display apparatus of claim 1, wherein the characteristic information of the driving transistor comprises:

a channel-length modulation parameter when the driving transistor operates in a saturated region.

4. The organic light-emitting display apparatus of claim 1, wherein the sensor comprises:

a reference voltage generator configured to generate the first reference voltage and the second reference voltage which are to be applied to the first node; and a current sensor configured to sense the first current and the second current.

5. The organic light-emitting display apparatus of claim 1, wherein the driving current determiner circuit is configured to:

determine a voltage of the first node when the first source data signal is transferred to the corresponding one of the pixels; and determine the driving current when the first source data signal is transferred to the corresponding one of the pixels, based on the characteristic information of the driving transistor and the current-voltage information of the OLED.

6. The organic light-emitting display apparatus of claim 1, further comprising:

a power supply configured to supply a first power voltage (ELVDD) and a second power voltage (ELVSS) to the plurality of pixels, wherein a difference between the first power voltage and a voltage of the first node determines a source-drain voltage of the driving transistor, and wherein a difference between the voltage of the first node and the second power voltage determines a voltage across the OLED.

7. The organic light-emitting display apparatus of claim 1, further comprising:

a sensing driver configured to generate and output a first sensing signal and a second sensing signal to a sensing line connected to the corresponding one of the pixels, wherein the sensor is configured to apply the first reference voltage to the first node and senses the first current in response to the first sensing signal, and to apply the second reference voltage to the first node and senses the second current in response to the second sensing signal.

8. The organic light-emitting display apparatus of claim 1, wherein the sensor senses an emission current flowing through the OLED in the state in which a reference voltage is applied to the first node, and wherein the organic light-emitting display apparatus further comprises a characteristic information generator configured to generate the current-voltage information of the OLED based on the emission current and to store the generated current-voltage information in the memory.

9. The organic light-emitting display apparatus of claim 1, wherein the corresponding one of the pixels is connected to:

a scan line configured to transfer a scan signal;

a gate line configured to transfer a gate signal;

a data line configured to transfer an image data signal and the first source data signal; and a sensing line configured to transfer a sensing signal.

10. The organic light-emitting display apparatus of claim 9, wherein the sensor is configured to receive the first current and the second current via the data line.

11. The organic light-emitting display apparatus of claim 9, further comprising:

a data driver for supplying the image data signal and the first source data signal to the corresponding one of the pixels; and a switching unit for selectively connecting the data line to any one of the data driver and the sensor.

12. The organic light-emitting display apparatus of claim 11, wherein the switching unit comprises:

a first selection switch which is connected between the data driver and the data line, the first selection switch being configured to transfer the image data signal and the first source data signal from the data driver to the corresponding one of the pixels in a turned-on state; and a second selection switch which is connected between the sensor and the data line, the second selection switch being configured to transfer the first current and the second current, output from the driving transistor, to the sensor in a turned-on state.

13. The organic light-emitting display apparatus of claim 9, wherein each of the pixels comprises:

a switching transistor configured to transfer the image data signal in response to the scan signal;

the driving transistor configured to output the driving current according to the image data signal via the first node;

a connection transistor configured to selectively connect the driving transistor and the OLED in response to the gate signal; and the sensing transistor configured to transfer the first current and the second current, output from the driving transistor, to the sensor in response to the sensing signal.

14. The organic light-emitting display apparatus of claim 13, wherein the scan signal has a gate-on voltage level of the switching transistor when the first source data signal and the image data signal are transferred to the corresponding one of the pixels.

15. The organic light-emitting display apparatus of claim 13, wherein the gate signal has a gate-off voltage level of the connection transistor when the first current and the second current are sensed by the sensor.

16. The organic light-emitting display apparatus of claim 13, wherein the sensing signal has a gate-on voltage level of the sensing transistor when the first current and the second current are sensed by the sensor.

17. The organic light-emitting display apparatus of claim 1, wherein the corresponding one of the pixels is connected to:

a scan line configured to transfer a scan signal;

a gate line configured to transfer a gate signal;

a data line configured to transfer an image data signal and the first source data signal;

a sensing line configured to transfer a sensing signal; and a connection line configured to transfer the first current and the second current to the sensor.

18. A method of driving an organic light-emitting display apparatus, the method comprising:

transferring a first source data signal, corresponding to a first gray level, to a pixel comprising an organic light-emitting diode (OLED), a capacitor, a driving transistor connected to the OLED via a first node, and a sensing transistor connected to the first node;

storing a first source data voltage corresponding to the first source data signal in the capacitor;

sensing a first current flowing from the driving transistor through the sensing transistor in a state in which a first reference voltage is applied to the first node through the sensing transistor when the capacitor stores the first source data voltage;

sensing a second current flowing from the driving transistor through the sensing transistor in a state in which a second reference voltage is applied to the first node through the sensing transistor when the capacitor stores the first source data voltage;

generating characteristic information of the driving transistor, based on the first current when the first reference voltage is applied and on the second current when the second reference voltage is applied; and determining a driving current of the driving transistor, corresponding to the first gray level, based on the characteristic information of the driving transistor and current-voltage information of the OLED.

19. The method of claim 18, further comprising:

transferring a second source data signal, corresponding to a second gray level that is different from a first target brightness, to the pixel;

storing a second source data voltage corresponding to the second source data signal in the capacitor;

sensing a third current flowing from the driving transistor in a state in which a third reference voltage is applied to the first node when the capacitor stores the second source data voltage; and determining a driving current of the driving transistor, corresponding to the second gray level, based on the third current when the third reference voltage is applied, on the characteristic information of the driving transistor, and on the current-voltage information of the OLED.

20. The method of claim 18, wherein the characteristic information of the driving transistor comprises a channel-length modulation parameter when the driving transistor operates in a saturated region.

* * * * *